US005270479A

United States Patent [19]

Kondo

[11] Patent Number: 5,270,479

[45] Date of Patent: Dec. 14, 1993

[54] ELECTRONIC MUSICAL INSTRUMENT WITH CHORD ACCOMPANIMENT STOP CONTROL

[75] Inventor: Masao Kondo, Hamamatsu, Japan

[73] Assignee: Yamaha Corporation, Hamamatsu, Japan

[21] Appl. No.: 910,227

[22] Filed: Jul. 9, 1992

[30] Foreign Application Priority Data

Jul. 9, 1991 [JP] Japan ..... 3-168510

[51] Int. Cl.[5] ..... G10H 1/38; G10H 1/40

[52] U.S. Cl. ..... 84/635; 84/637; 84/DIG. 12; 84/DIG. 22

[58] Field of Search ..... 84/611-613, 84/635-637, DIG. 12, DIG. 22

[56] References Cited

U.S. PATENT DOCUMENTS 4,315,451 2/1982 Uchiyama et al. ..... 84/DIG. 12

4,344,345 8/1982 Sano ..... 84/DIG. 12

5,056,401 10/1991 Yamaguchi et al. ..... 84/635

FOREIGN PATENT DOCUMENTS 1-79091 7/1989 Japan .

*Primary Examiner*—Stanley J. Witkowski

*Attorney, Agent, or Firm*—Spensley Horn Jubas & Lubitz

[57] ABSTRACT

The electronic musical instrument is provided with an accompaniment pattern memory storing a prescribed automatic accompaniment pattern composed of, at least, a chord tone part and a rhythm tone part, a keyboard manually operable to generate a command to designate temporary elimination of the chord tone part from the automatic accompaniment, a CPU responsive to the command from the keyboard to inactivate the chord tone part in the automatic accompaniment pattern, and a sound source circuit for performing the rhythm tone part of the automatic accompaniment pattern while inhibiting generation of the chord tones.

18 Claims, 6 Drawing Sheets

ELECTRONIC MUSICAL INSTRUMENT WITH CHORD ACCOMPANIMENT STOP CONTROL

BACKGROUND OF THE INVENTION

The present invention relates to an electronic musical instrument having automatic accompaniment function.

In a conventional electronic musical instrument having an automatic accompaniment function described, for example, in U.S. Pat. No. 5,056,401, a rhythm part of a given automatic accompaniment pattern is performed immediately after starting the automatic accompaniment performance, while a chord part is not performed until a certain chord is inputted and detected. Once a chord is detected, the chord part is performed continuously according to the detected chord. In the above conventional electronic musical instrument, once a chord is detected after starting the automatic accompaniment performance, the chord part is compulsorily produced according to the detected chord. Thereafter, the chord part performance is continued so that the chord tones are never stopped by any manual operation except for reducing a volume of the chord tones to a zero level. Normally, the control of the tone volume level is not conducted quickly and therefore is not practical in a real time basis performance. Consequently, the conventional automatic accompaniment method has the drawback that a player cannot select a rhythm part exclusively while inhibiting the chord part in a practical manner once starting the automatic accompaniment performance.

SUMMARY OF THE INVENTION

In view of the above noted drawback of the prior art, an object of an embodiment of the present invention is to eliminate or inhibit chord tones of the automatic accompaniment according to a manner of the musical performance by a quick and practical operation of the electronic musical instrument. The electronic musical instrument is provided with memory means for storing a prescribed pattern of an automatic accompaniment composed of, at least, a first part of chord tones and a second part of rhythm tones, command means for generating a command to designate elimination of chord tones from the automatic accompaniment, control means responsive to the command for inactivating the first part of chord tones in the automatic accompaniment pattern, and performing means for performing the second part of rhythm tones according to the automatic accompaniment pattern while inhibiting the first part of chord tones. According to such a construction of the instrument, a player can manually designate elimination or removal of the chord tones from the automatic accompaniment through the command means, so that the control means operates in response to a command from the command means to inactivate the chord tone part. By such operation, the player can conduct the automatic accompaniment while inhibiting chord tone generation through the performing means.

In more detail, the inventive an embodiment of the electronic musical instrument is comprised of producing means for producing performance data representing a music performance. Memory means is provided for storing a pattern of an automatic performance composed of a chord part and a rhythm part. The chord part is a tone pattern representing production of tones corresponding to a predetermined chord, and the rhythm part is a rhythm pattern representing production of a rhythm instrument. Chord detecting means is provided for detecting that a chord corresponding to said predetermined chord has been established on said performance data and for producing a chord detecting signal accordingly. Automatic performance means performs the established chord based on the chord part in response to the chord detecting signal, and performs the rhythm part. Special performance detecting means detects a special performance manner from the performance data, and produces a special manner signal accordingly. The special performance manner is a performance manner except for the established chord. For example, the special performance manner is a simultaneous performance of at least three consecutive tones. Inhibiting means is provided for inhibiting the automatic performance means from performing the established chord in response to the special manner signal.

DETAILED DESCRIPTION OF THE INVENTION

Figure 1:
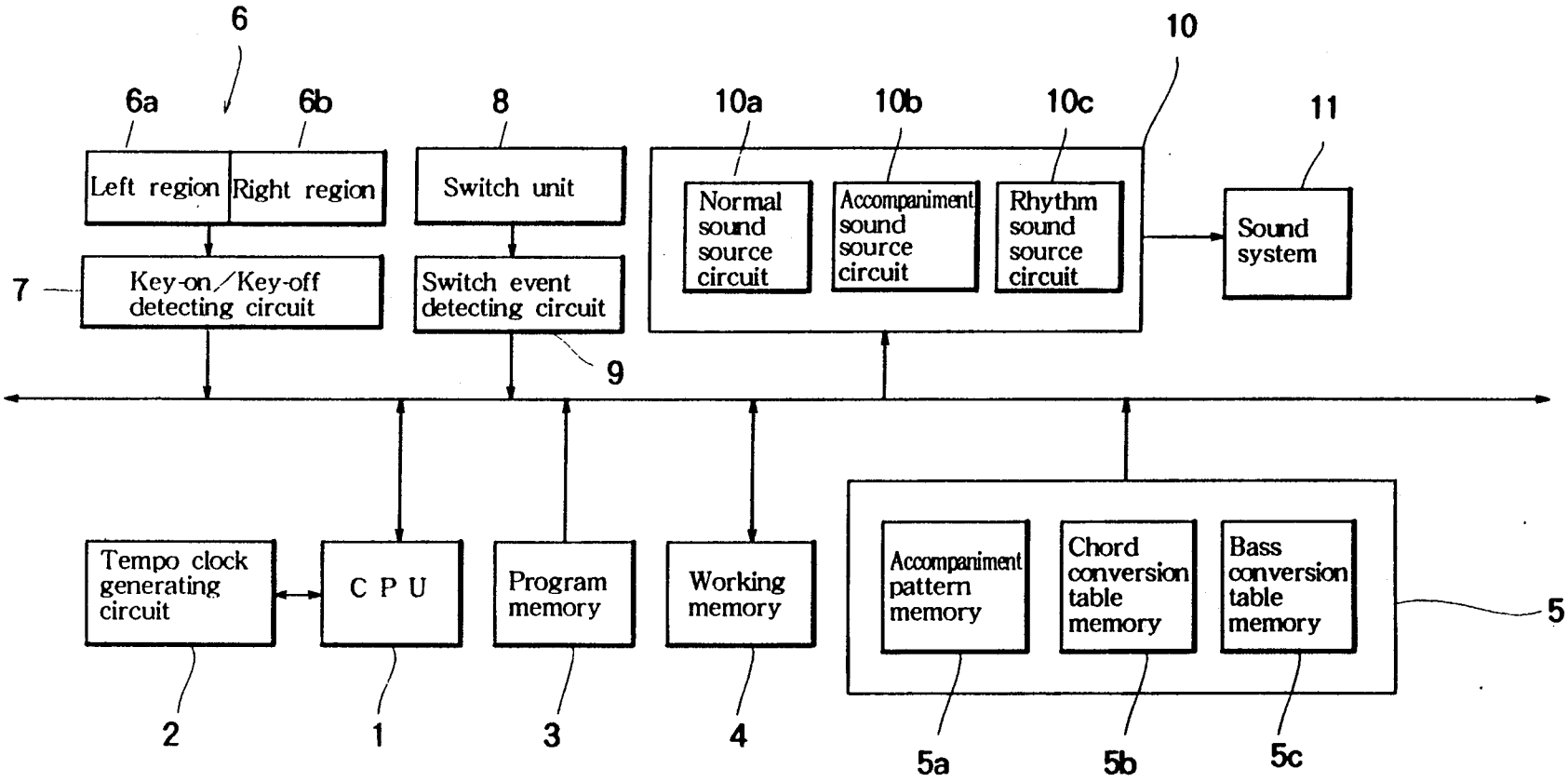
FIG. 1 is a block diagram showing an overall construction of one embodiment of the electronic musical instrument.
Figure 2:
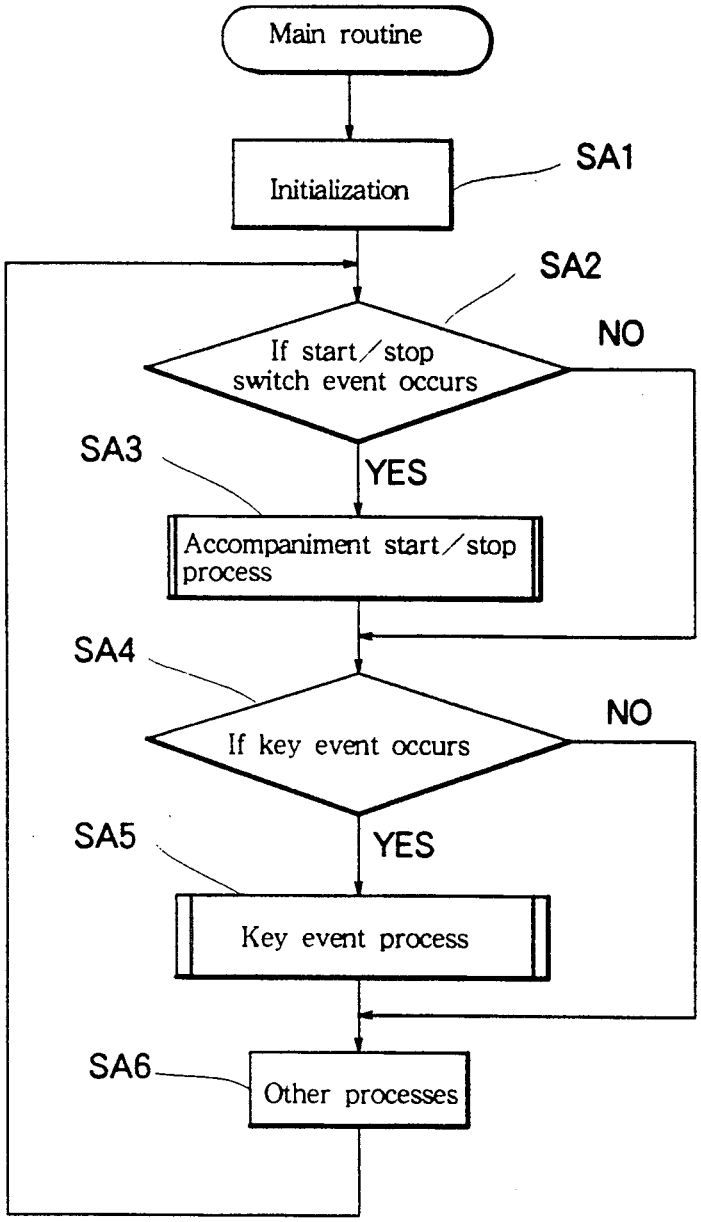
FIG. 2 is a flowchart showing a main routine process of a CPU in the embodiment of the electronic musical instrument.

Hereinafter, one embodiment of the invention will be described in conjunction with the drawings. FIG. 1 is a block diagram showing an overall construction of the embodiment electronic musical instrument. In the figure, the instrument is comprised of a central processing unit or CPU 1 for controlling various units involved in the instrument, and a tempo clock generating circuit 2 receptive of tempo data outputted from the CPU 1 for generating a tempo clock in the form of a timer interruption pulse which is generated periodically each given time interval, for example, each eighth note determined by the tempo data and which is fed back to the CPU 1.

The instrument further includes a program memory 3 composed of a ROM storing a control program executed by the CPU 1, a working memory 4 containing therein various registers and flags used when the CPU 1 carries out various processes, and a data memory 5 composed of another ROM which stores various data and which comprises an accompaniment pattern memory 5*a*, a chord conversion table memory 5*b* and a bass conversion table memory 5*c*. Among these, the accompaniment pattern memory 5*a* stores an automatic accompaniment pattern is two measures length for each track. The accompaniment pattern is comprised of key codes generated sequentially at a given timing, e.g., eighth note in the automatic accompaniment mode, a type of rhythm, and certain data indicative of silencing intervals, for example, $FF_H$ which is represented by the hexadecimal notation.

The instrument is still further provided with a keyboard 6 having a plurality of keys divided into a left region 6*a* assigned to the accompaniment performance and a right region 6b assigned normally for playing a melody part. A key-on/key-off detecting circuit 7 is connected to the keyboard 6 for detecting a key event to output key event information. A switch unit 8 contains various switches such as an accompaniment start/-stop switch, and a switch event detecting circuit 9 is connected to detect any switch event. A sound source circuit 10 is controlled by the CPU 1 to generate a musical tone signal, and is comprised of a normal sound source circuit 10a, an accompaniment sound source circuit 10b used for the automatic accompaniment and a rhythm sound source circuit 10c for generating solely a rhythm tone signal. A sound system 11 is comprised of an amplifier, a speaker and so on for receiving the musical tone signal from the sound source circuit 10 so as to generate a musical tone.

Next in such a construction, the operation of the CPU 1 will be described in conjunction with the flowcharts of FIGS. 2–6. When the electronic musical instrument of FIG. 1 is powered, the CPU 1 firstly undertakes Step SA1 of a main routine shown in FIG. 2 to carry out initialization of initial settings. The initial settings include a setting of an initial tone color for the sound source circuit 10 and a clearing of various registers provided in the working memory 4. Then, the processing of CPU 1 advances to Step SA2.

In Step SA2, judgment is made as to whether an event of the automatic accompaniment start/stop switch occurs. Namely, the CPU 1 checks to see if the player actuates the automatic accompaniment start/-stop switch in the switch unit 8 and checks to see if the switch event detecting circuit 9 detects that switch event. If judgment is held YES, the processing advances to Step SA3. The automatic accompaniment start/stop process is effected in Step SA3. The detail of this process will be described later with reference to FIG. 3.

Then, the processing advances to Step SA4. Also, if the judgment is held NO in Step SA2, i.e., there is no event of the automatic accompaniment start/stop switch, the processing jumps to Step SA4. Check is made to see if a key event occurs in Step SA4. Namely, Step SA4 is carried out to check to see whether any key is depressed or released by the player and the key-on/key-off detecting circuit 7 detects that key event. In case the check result is held YES, next Step SA5 is undertaken. A key event process is carried out to deal with the depression or release of a key in Step SA5. The detail of the key event process will be described later with reference to FIG. 4.

Then the processing proceeds to Step SA6. Also if the check is held NO in previous Step SA4, i.e., if there is no key event, the processing jumps to Step SA6. Processes other than the above described processes are carried out in Step SA6, thereby returning to Step SA2.

Figure 3:
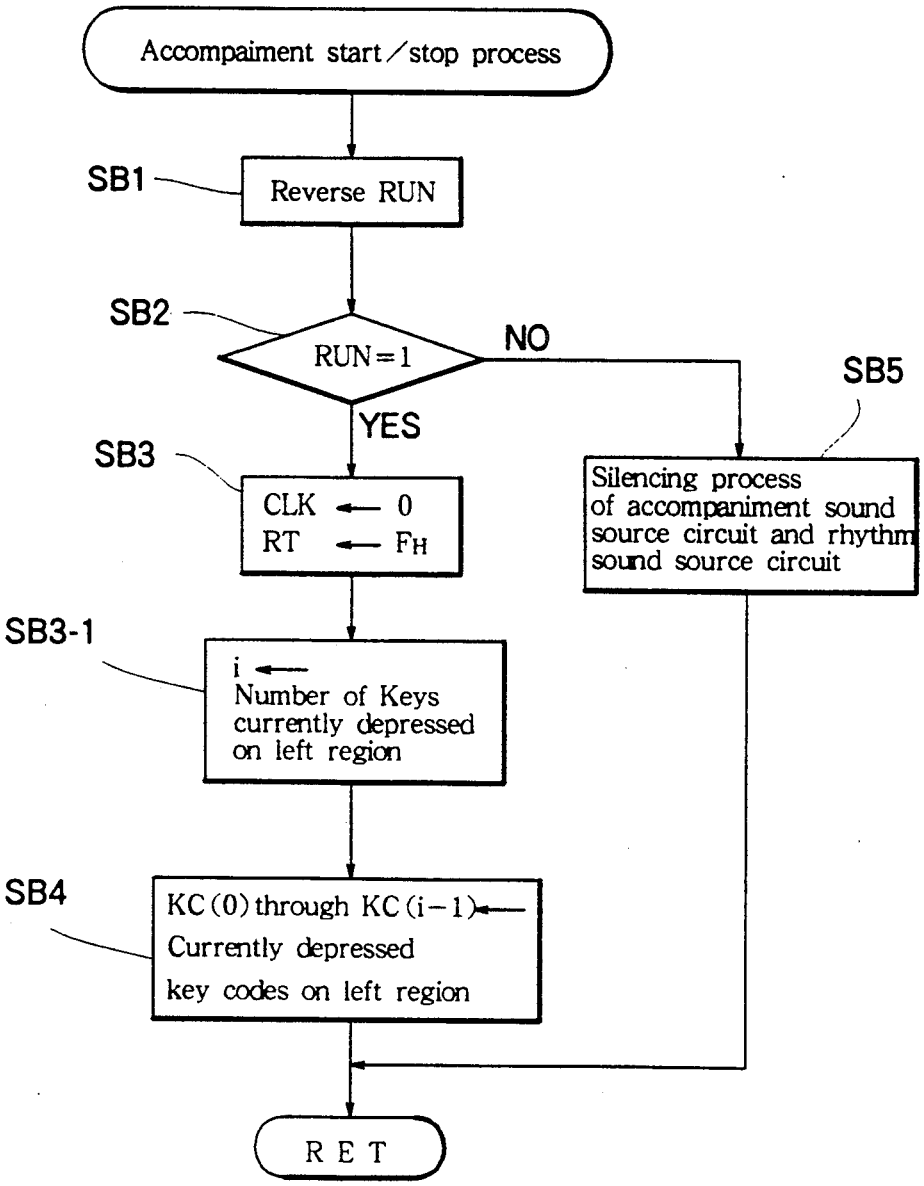
FIG. 3 is a flowchart showing an accompaniment start/stop process of a CPU.

Referring to FIG. 3 which is a flowchart of the above-mentioned accompaniment start/stop process, firstly Step SB1 is carried out in this routine to reverse a state of a flag RUN which should be set to "1" during the course of performing the automatic accompaniment. Namely, if the flag RUN has been set to "1", the flag RUN is reset to "0". On the other hand, if the flag RUN has been set to "0", the flag RUN is reset to "1". Then, the processing of CPU 1 advances to Step SB2. Check is made in Step SB2 as to whether the flag RUN is currently set with "1" in order to judge whether the player commands a start of the automatic accompaniment. If the check is held YES, i.e., if the flag RUN is set with "1", this means that the automatic accompaniment start/stop switch is turned from the automatic accompaniment stop state, thereby proceeding to Step SB3 for start settings of the automatic accompaniment.

A value of a register CLK which stores a four-bit clock is reset in Step SB3 and a datum $F_H$ indicative of inhibiting chord tone generation is stored in a register RT which normally stores a root note code of an inputted chord. Thereafter, the processing advances to Step SB3-1. In this Step, a register i is stored with a number of keys currently depressed on the left region of the keyboard. Then, in Step SB4, registers KC(0) through KC(i-1) are stored with key codes of keys currently depressed on the left region of the keyboard. Thereafter, the processing returns to the main routine of FIG. 2 to thereby proceed to Step SA4.

On the other hand, if the check result of Step SB2 is held NO, i.e., if the flag RUN is set with "0", this means that the automatic accompaniment start/stop switch is turned from the performing state of the automatic accompaniment, thereby advancing to Step SB5. Silencing operation of the accompaniment sound source circuit 10b and the rhythm sound source circuit 10c is effected in Step SB5, thereby returning to the main routine of FIG. 2 to proceed to Step SA4.

Figure 4:
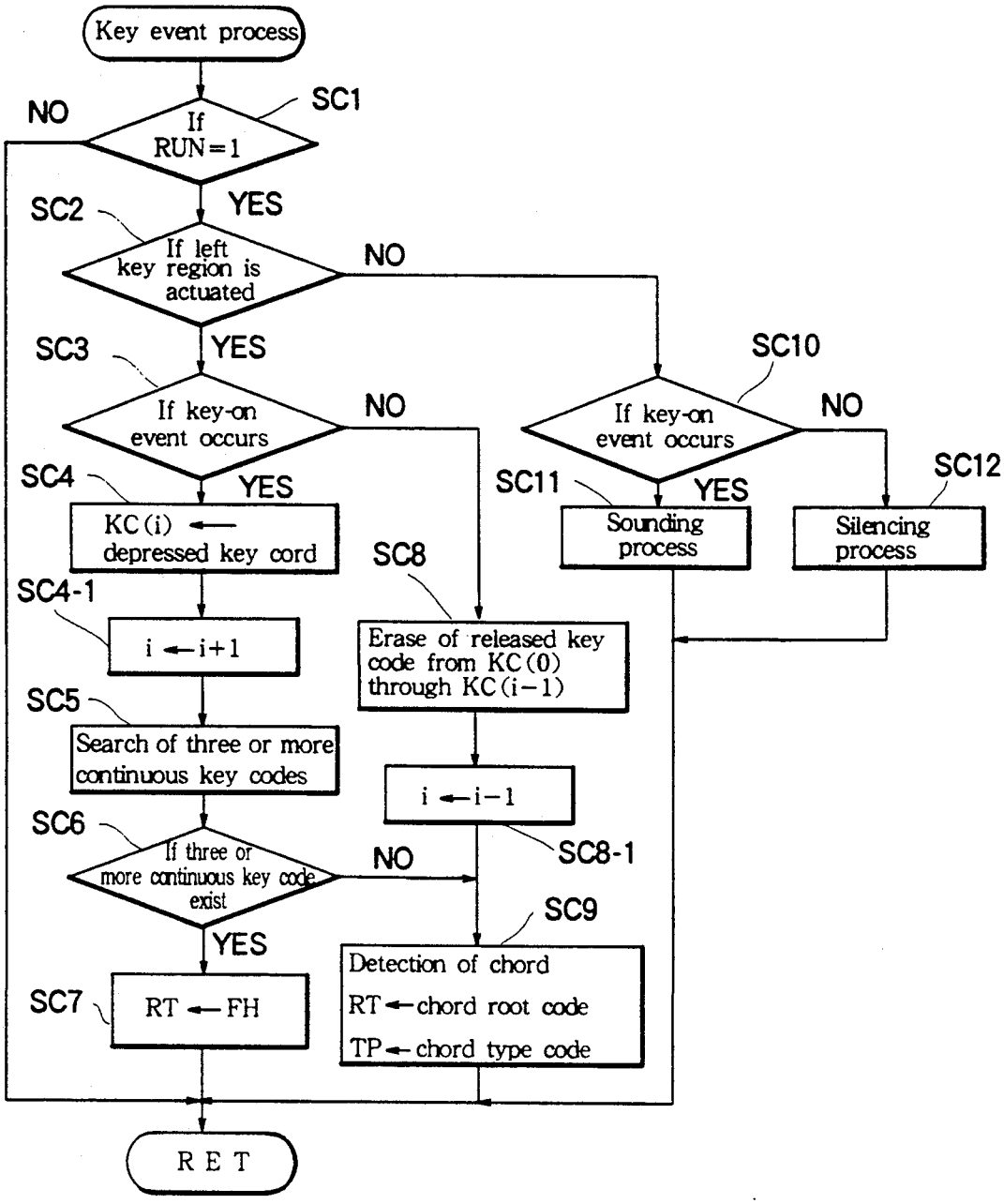
FIG. 4 is a flowchart showing a key event process conducted by a CPU.

Referring to FIG. 4, which is a flowchart showing the above-mentioned key event process, firstly Step SC1 is carried out in this routine to check whether the flag RUN is set with "1". If the check result is held NO, the processing returns immediately without any operation to the main routine of FIG. 2 to thereby proceed to Step SA6. On the other hand, if the check result of Step SC1 is held YES, indicating that the flag RUN is set with "1", the processing advances to Step SC2. A check is made as to whether the actuated key belongs to the left key region 6a in Step SC2. If this check result is held YES, the processing advances to Step SC3. A subsequent check is made as to whether the detected key event is a key-on event. If this check result shows YES, the processing advances to Step SC4. A key code of the currently depressed key is written into the register KC (i), thereafter advancing to Step SC4-1 where i is incremented by one.

Step SC5 is carried out to search a set of three or more continuous written key codes, thereafter advancing to Step SC6. Judgment is made in Step SC6 as to whether there exists the set of three or more continuous key codes. If this judgment is held YES, the processing advances to Step SC7. The datum $F_H$ indicative of inhibiting chord tone generation is written by Step SC7 into the register RT which normally stores a root note code of an inputted chord, thereafter returning to the main routine of FIG. 2 to proceed to Step SA6. On the other hand, if the judgment result of Step SC6 is held NO, i.e., if there exists no set of three or more continuous key codes, the processing branches to Step SC9. The above noted sequence of Steps SC5, SC6 and SC7 is undertaken to inhibit chord tone generation during the course of automatic accompaniment. Namely, the player depresses three or more continuous or adjacent keys intentionally in a peculiar manner to command inhibition or suspension of the chord part of the accompaniment pattern.

Referring to Step SC3, if the check result is held NO, indicating that the detected key event is not a key-on event but is a key-off event, the processing branches to Step SC8. The key code of a currently released key is erased from a corresponding one of the register KC(0)

through the register KC(i-1), and then i is decremented by one in Step SC8-1, thereby advancing to Step SC9. Step SC9 is executed to detect a chord which is inputted from the left region of the keyboard. Then, a root note code of the detected chord is written into the register RT and a type code of the detected chord is written into the register TP, thereafter returning to the main routine of FIG. 2 to proceed to Step SA6.

Referring to Step SC2, if the check result is held NO, i.e., if the actuated or detected key does not belong to the left key region 6a but belongs to the right key region 6b, the processing branches to Step SC10 in which check is made as to whether the detected key event is a key-on event. If the check result is held YES, the processing advances to Step SC11. Tone generation operation is effected for the detected key in Step SC11, thereafter returning to the main routine of FIG. 2 to advance to Step SA6. On the other hand, if the check result of Step SC10 is held NO, i.e., if the detected key event is not a key-on event but is a key-off event, the processing branches to Step SC12 in which tone erasing operation is effected for the detected key, thereafter returning to the main routine of FIG. 2 to proceed to Step SA6.

Figure 5:
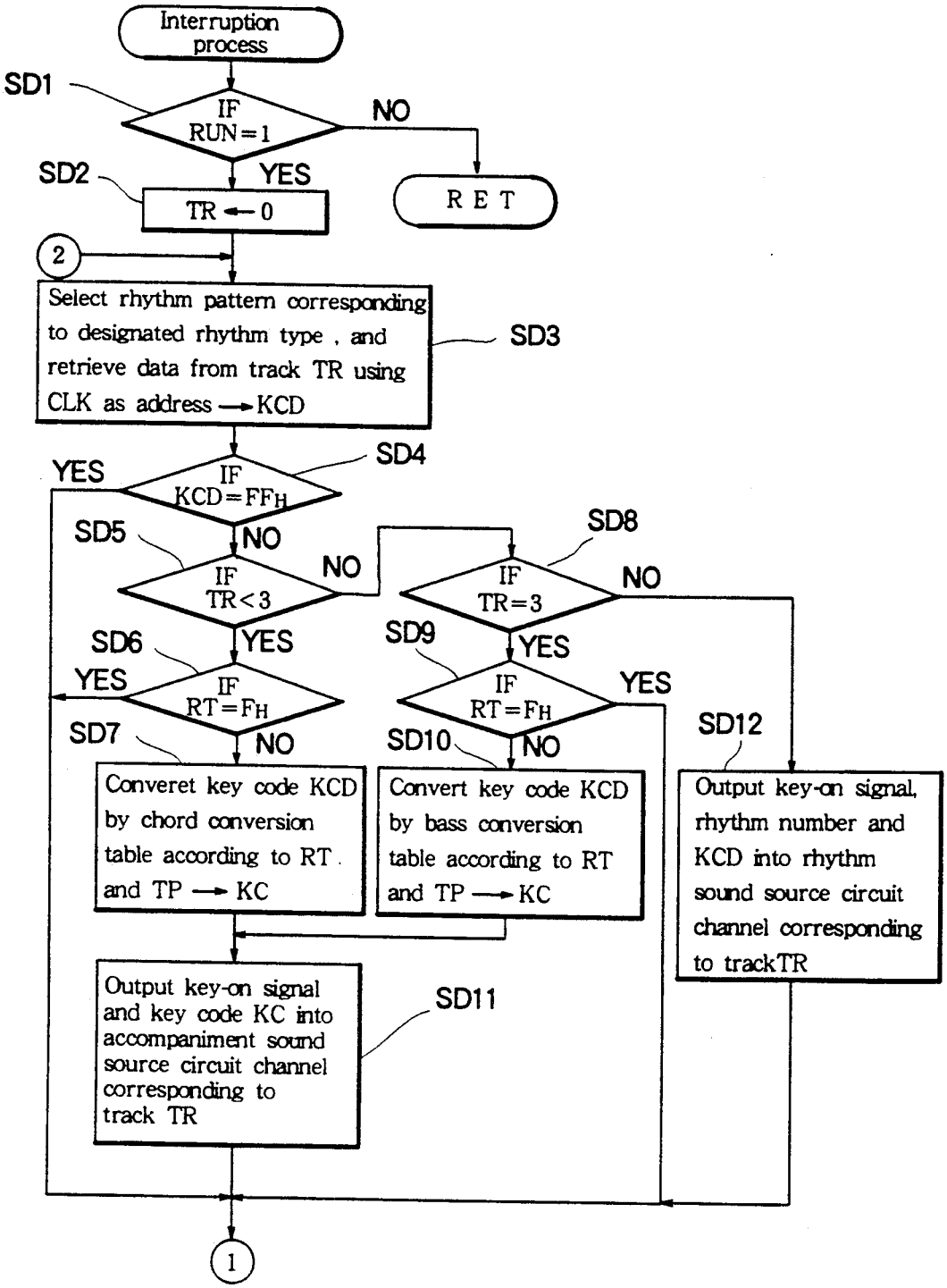
FIGS. 5 and 6 are a flowchart showing an interruption process routine conducted by a CPU.

Next, the interruption process routine is described with reference to FIGS. 5 and 6. This interruption process routine is called in response to a timer interruption pulse which is fed each eighth note from the tempo clock generating circuit 2 of FIG. 1. Firstly in Step SD1 of FIG. 5, check is made to to if the flag RUN is set with "1". If the check result shows NO, the processing returns to the main routine of FIG. 2 without undertaking any operation. On the other hand, if the check result of Step SD1 is held YES, i.e., if the flag RUN is set with "1", the processing advances to Step SD2. A register TR is initially loaded with a track code 0 which denotes a first track of the accompaniment pattern, thereafter advancing to Step SD3. In the present embodiment, track codes 0, 1 and 2 denote different chord tracks, a track code 3 denotes a bass track and track codes 4 and 5 denote different rhythm tracks.

In Step SD3, a rhythm pattern is selected corresponding to a type of rhythm designated by the player. Further, data of a certain track designated by the track code stored in the register TR is retrieved and written into the register KCD using the content of the register CLK as an address, thereafter advancing to Step SD4. A check is made in Step SD4 as to whether the value of the register KCD is a datum $FF_H$ which indicates silencing. If the check result shows NO, the processing advances to Step SD5.

In Step SD5, a check is made to see if the content of the register TR is smaller than 3, i.e., to see if the registered track code indicates 0, 1 or 2, which designates one of the chord tracks. If this check result shows YES, the processing advances to Step SD6. A subsequent check is made in Step SD6 to see if the register RT is written with a datum $F_H$ which indicates inhibition of chord tone generation. If this check result shows NO, the processing advances to Step SD7. In this step, the key code written in the register KCD is converted using the chord conversion table memorized in the memory 5b shown in FIG. 1 according to both of the root note code of the detected chord stored in the register RT and the chord type stored in the register TP. Further, the converted key code is transferred to the register KC, thereafter advancing to Step SD11.

Referring to Step SD5, if the check result is held NO, i.e., if the value of the register TR is not less than a value 3, the processing branches to Step SD8. A subsequent check is made to see if the value of the register TR is equal to a number 3. In case the check result shows YES, the processing advances to SD9. A check is made in Step SD9 to see if the register RT holds a specific command datum $F_H$ indicative of inhibiting the generation of the chord tone. If this check result shows NO, the processing advances to Step SD10. The original key code is converted using the bass conversion table memorized in the memory 5c according to the root note code of the detected chord held in the register RT and the chord type held in the register TP. Further, the converted key code is transferred to and stored in the register KC. Thereafter the processing advances to Step SD11. In this step, a key-on signal and the key code stored in the register KC are outputted into a particular channel of the accompaniment sound source circuit 10b, which corresponds to the track code stored in the register TR.

Referring to Step SD8, if the check result shows NO, i.e., if the value of the register TR is not the track code 3, the processing branches to Step SD12. In this Step, a key-on signal, a selected rhythm number and the key code stored in the register KCD are outputted into a particular channel of the rhythm sound source circuit 10c, which corresponds to the track code stored in the register TR. Thereafter the processing advances to Step SD13.

Figure 6:
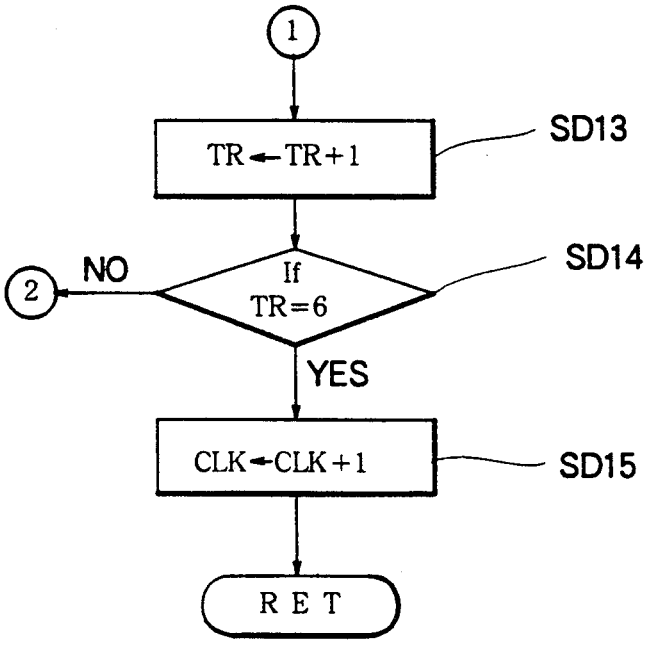

Referring to Step SD4, if the check result shows YES, i.e., if the value of the register KCD indicates a datum $FF_H$ which denotes a tone silencing, the processing advances to Step SD13 of FIG. 6. Further, if either of the check results of Steps SD6 and SD9 shows YES, namely, if the register RT stores a specific command datum $F_H$ indicative of inhibition of the chord tone generation, the processing also advances to Step SD13 of FIG. 6.

In Step SD13, the value of the register TR is incremented by one unit, thereafter advancing to Step SD14. A check is made in Step SD14 as to whether the value of the register TR reaches a track code 6. If the value of the register TR indicates none of the above-mentioned chord, bass and rhythm tracks, the processing advances to Step SD15. The value of the register CLK is incremented by one unit, thereafter returning to the main routine of FIG. 2. On the other hand, if the check result of Step SD14 shows NO, the processing returns to Step SD3 of FIG. 5.

With regard to the processings of Steps SD7 and SD10, a detailed description can be found in Japanese Patent Application Laid-Open No. 179091/1989 which was previously filed in Japan by the assignee of the present application. In summary, the prescribed accompaniment pattern is memorized in terms of a fixed chord. On the other hand, the player inputs chord information by operating keys of the left region of the keyboard. The inputted chord is detected to determine a root note code and a type thereof. A respective key code retrieved from the prescribed accompaniment pattern or chord pattern is converted according to the root note code and the type of detected chord using a chord conversion table.

In the above described embodiment, the player intentionally depresses in a peculiar or special manner three or more continuous keys in the left region 6a of the keyboard to generate a command which inhibits chord tone and bass tone generation while allowing only the rhythm tone to be generated during the course of the automatic accompaniment. However, the present invention is not limited to this commanding manner. For example, upon discontinuation of such a peculiar manipulation as simultaneous depression of three or more continuous keys, only the rhythm tones are generated from a following measure. Alternatively, in the event of absence of such a peculiar manipulation for a given time interval, only the rhythm tone is generated. Further, only the rhythm tone may be generated when a specific operation switch is actuated, or when a chord is not detected.

The above-described embodiment is provided with the normal sound source circuit 10*a*, the accompaniment sound source circuit 10*b* and the rhythm sound source circuit 10*c*; however, these sound source circuits may be integrated in a single sound source circuit.

As described above, according to the present invention, a chord tone of the automatic accompaniment can be eliminated or inhibited by a quick and easy operation, thereby improving expression variety of the automatic accompaniment.

What is claimed is:

1. An electronic musical instrument comprising:

producing means for producing performance data representing a music performance;

memory means for storing a pattern of an automatic performance composed of a chord part and a rhythm part, said chord part being a tone pattern representing production tones corresponding to a predetermined chord, and said rhythm part being a rhythm pattern representing production of a rhythm instrument;

chord detecting means for detecting that an established chord corresponding to said predetermined chord has been established on said performance data and for producing a chord detecting signal;

automatic performance means for performing said established chord based on said chord part in response to said chord detecting signal and for performing said rhythm part;

special performance detecting means for detecting a special performance manner from said performance data and for producing a special manner signal, wherein said special performance manner is a performance manner different from said established chord; and inhibiting means for inhibiting said automatic performance means from performing said established chord in response to said special manner signal.

2. An electronic musical instrument according to claim 1, wherein said special performance manner is a performance manner representing a simultaneous performance of at least three chord tones.

3. An electronic musical instrument according to claim 1, further comprising a keyboard having a plurality of keys, and wherein said performance data represents a series of tones corresponding to sequentially depressed keys from among said plurality of keys.

4. An electronic musical instrument according to claim 1, wherein the established chord is comprised of chord tones and bass tones.

5. An electronic musical instrument according to claim 1, wherein the inhibiting means inhibits the established chord until the special manner signal stops.

6. An electronic musical instrument according to claim 1, wherein the rhythm part continues to be performed for a predetermined period of time after the established chord is inhibited.

7. An electronic musical instrument comprising:

input means for inputting performance information containing chord data and peculiar data;

memory means for storing a prescribed pattern for an automatic accompaniment composed of at least a first part of chord tones and a second part of rhythm tones;

performing means for performing the first part of chord tones according to the inputted chord data concurrently with the second part of rhythm tones to provide the automatic accompaniment;

command means operative when the peculiar data is inputted for providing a command to designate elimination of chord tones from the automatic accompaniment; and control means responsive to the command for selectively inactivating the first part of chord tones in the pattern of the automatic accompaniment, such that the performing means performs the second part of rhythm tones according to the pattern of the automatic accompaniment while inhibiting the first part of chord tones.

8. An electronic musical instrument according to claim 7, wherein the input means includes a keyboard manually operable in a peculiar manner different from a normal manner of inputting chord data to input the peculiar data, such that the command is provided to inhibit the first part of chord tones.

9. An electronic musical instrument according to claim 8, wherein the command means includes means for detecting when three or more keys are continually depressed in a peculiar manner on the keyboard to provide the command.

10. An electronic musical instrument according to claim 7, wherein the first part of chord tones is comprised of chord tones and bass tones.

11. An electronic musical instrument according to claim 7, wherein the control means inhibits the first part of chord tones until the command stops.

12. An electronic musical instrument according to claim 7, wherein the second part of rhythm tones continues to be performed for a predetermined period of time after the first part of chord tones is inhibited.

13. An method for controlling accompaniment in an electronic musical instrument, the method comprising the steps of:

inputting performance information containing chord data and peculiar data;

storing a prescribed pattern for an automatic accompaniment composed of at least a first part of chord tones and a second part of rhythm tones;

performing the first part of chord tones according to the inputted chord data concurrently with the second part of rhythm tones to provide the automatic accompaniment;

providing a command to designate elimination of chord tones from the automatic accompaniment when the peculiar data is inputted; and selectively inactivating the first part of chord tones in the pattern of the automatic accompaniment in response to the command, such that the second part of rhythm tones is performed according to the pattern of the automatic accompaniment while inhibiting the first part of chord tones.

14. A method according to claim 13, further comprising using a keyboard to manually input peculiar data in a peculiar manner different from a normal manner to input the chord data, such that the command is provided to inhibit the first part of chord tones.

15. A method according to claim 14, further comprising detecting when three or more keys are continually depressed in a peculiar manner on the keyboard to provide the command.

16. An method according to claim 13, further comprising providing the first part of chord tones with chord tones and bass tones.

17. An method according to claim 13, further comprising inhibiting the first part of chord tones until the command stops.

18. An method according to claim 13, further comprising continuing to perform the second part of rhythm tones for a predetermined period of time after the first part of chord tones is inhibited.

* * * * *